US010539319B2

(12) United States Patent
Dunphy

(10) Patent No.: US 10,539,319 B2
(45) Date of Patent: Jan. 21, 2020

(54) TORCH REFILLING ASSEMBLY

(71) Applicant: Richard Dunphy, Huntingtown, MD (US)

(72) Inventor: Richard Dunphy, Huntingtown, MD (US)

( * ) Notice: Subject to any disclaimer, the term of this patent is extended or adjusted under 35 U.S.C. 154(b) by 37 days.

(21) Appl. No.: 15/901,679

(22) Filed: Feb. 21, 2018

(65) Prior Publication Data

US 2019/0257512 A1 Aug. 22, 2019

(51) Int. Cl.
*F21V 37/00* (2006.01)
*B67C 11/04* (2006.01)
*B67C 11/00* (2006.01)

(52) U.S. Cl.
CPC ..... *F21V 37/0012* (2013.01); *B67C 11/04* (2013.01); *B67C 2011/20* (2013.01)

(58) Field of Classification Search
CPC ... F21V 37/0012; B67C 11/04; B67C 2011/20
USPC ..... 141/331–345
See application file for complete search history.

(56) References Cited

U.S. PATENT DOCUMENTS 2,024,168 A * 12/1935 Kneer ..... B67C 11/04 141/344
2,694,515 A * 11/1954 Green ..... B65B 1/28 141/300
2,858,050 A * 10/1958 Barnard ..... B67B 7/28 141/331
3,603,358 A * 9/1971 Mallindine ..... B44D 3/128 141/343
D244,171 S 5/1977 Pearce
4,934,420 A * 6/1990 Radna ..... A47J 43/284 141/331
5,085,135 A * 2/1992 Collignon ..... A47J 31/06 141/344
5,228,488 A * 7/1993 Fletcher ..... B67C 11/04 141/331
5,350,091 A * 9/1994 Leete ..... B65D 25/385 141/337
5,662,249 A * 9/1997 Grosse ..... B65D 47/147 141/319
5,967,201 A * 10/1999 Gasior ..... B67C 11/04 141/106
6,341,631 B1 1/2002 Hobbs
7,191,773 B2 * 3/2007 Vincent ..... F41B 11/52 124/45
7,299,834 B1 11/2007 Platt
7,614,432 B2 11/2009 Shaw
8,813,563 B2 * 8/2014 Tharp ..... G01F 19/00 141/331

(Continued)

*Primary Examiner* — Timothy L Maust

(57) ABSTRACT

A torch refilling assembly includes a funnel for receiving a liquid fuel. A spout is fluidly coupled to the funnel and the spout is positioned in an opening of a fuel canister of a torch to direct the liquid fuel into the fuel canister of the torch. A rest is coupled to and extends laterally away from the funnel for engage a lid of the fuel canister for storage when the fuel canister is filled with the liquid fuel. A valve is movably coupled between the funnel and the spout. The valve is selectively positioned in a closed position to inhibit the liquid fuel from flowing out of the funnel. The valve is selectively positioned in an open position to pass the liquid fuel therethrough thereby facilitating the fuel canister to be filled with the liquid fuel.

10 Claims, 5 Drawing Sheets

(56) References Cited

U.S. PATENT DOCUMENTS

| | | | | |
|---|---|---|---|---|
| 8,950,448 | B2 * | 2/2015 | Jameson | B67C 11/04 141/331 |
| 2003/0127469 | A1 | 7/2003 | Terry | |
| 2009/0223596 | A1 | 9/2009 | Wang | |

* cited by examiner

TORCH REFILLING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to refilling devices and more particularly pertains to a new refilling device for pre-filling a selected amount of liquid fuel for a.

BRIEF SUMMARY OF THE INVENTION

An embodiment of the disclosure meets the needs presented above by generally comprising a funnel for receiving a liquid fuel. A spout is fluidly coupled to the funnel and the spout is configured to be positioned in an opening of a fuel canister of a torch to direct the liquid fuel into the fuel canister of the torch. A rest is coupled to and extends laterally away from the funnel for engage a lid of the fuel canister for storage when the fuel canister is filled with the liquid fuel. A valve is movably coupled between the funnel and the spout. The valve is selectively positioned in a closed position to inhibit the liquid fuel from flowing out of the funnel. The valve is selectively positioned in an open position to pass the liquid fuel therethrough thereby facilitating the fuel canister to be filled with the liquid fuel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
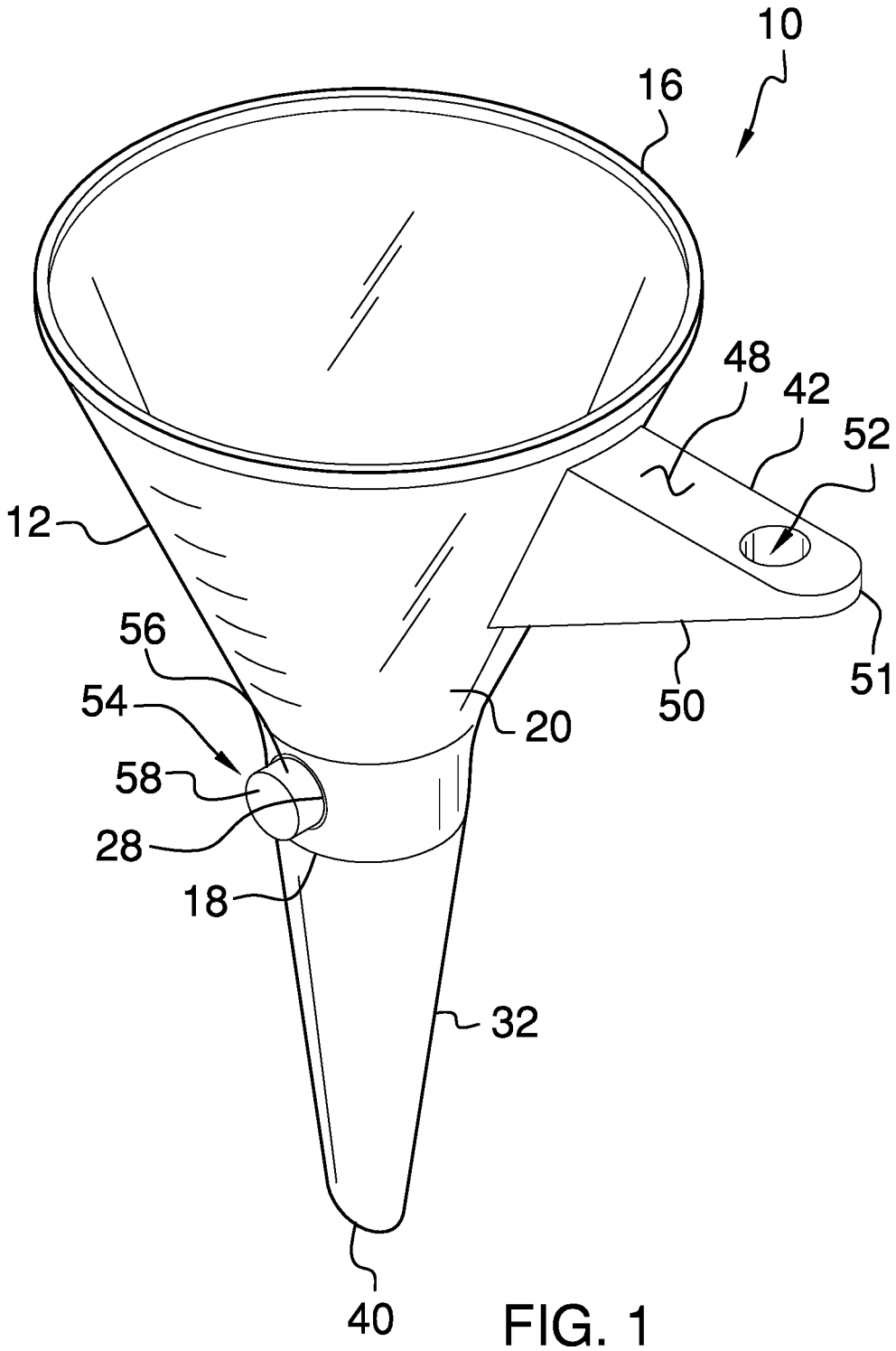
FIG. 1 is a top perspective view of a torch refilling assembly according to an embodiment of the disclosure.
Figure 2:
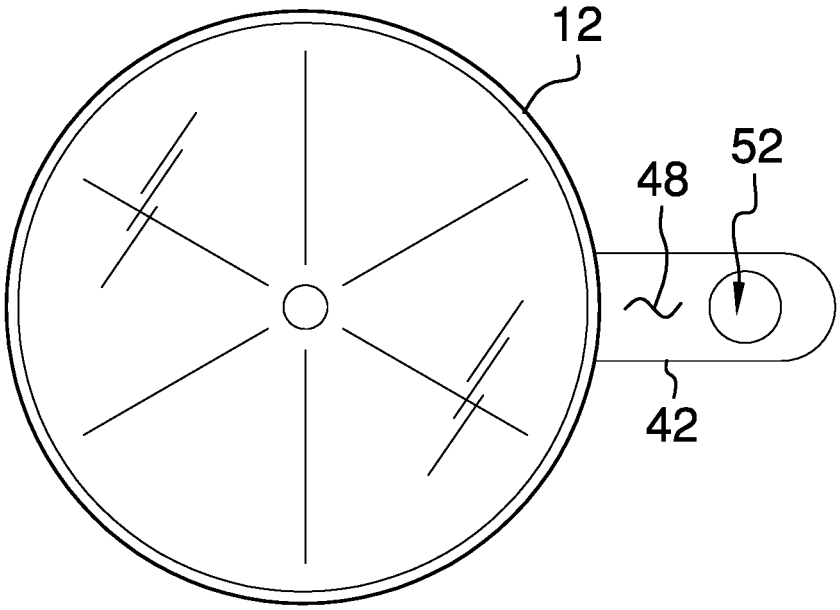
FIG. 2 is a top view of an embodiment of the disclosure.
Figure 3:
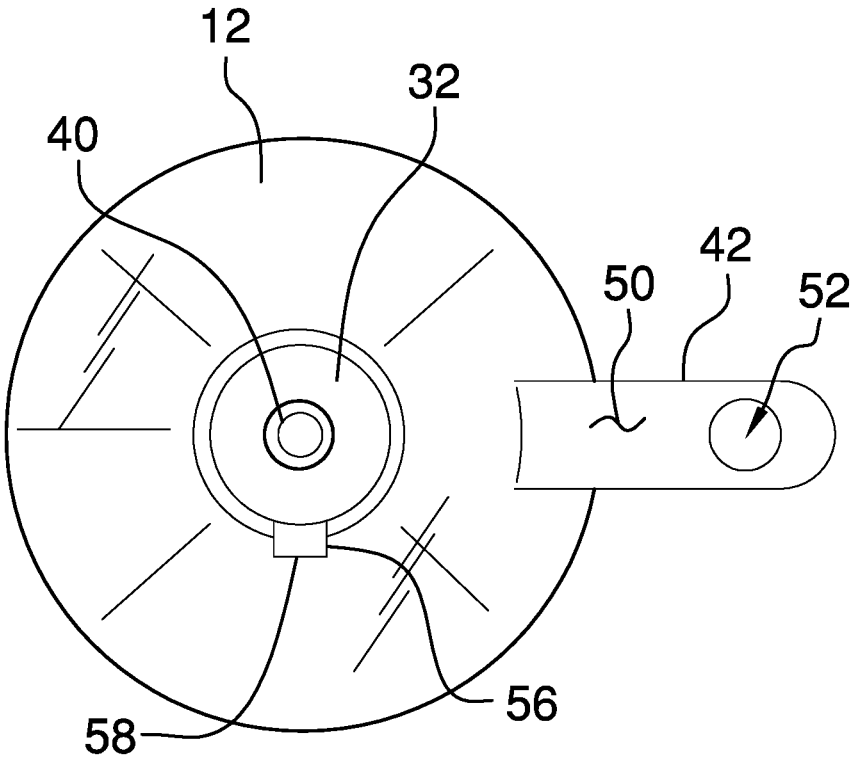
FIG. 3 is a bottom view of an embodiment of the disclosure.
Figure 4:
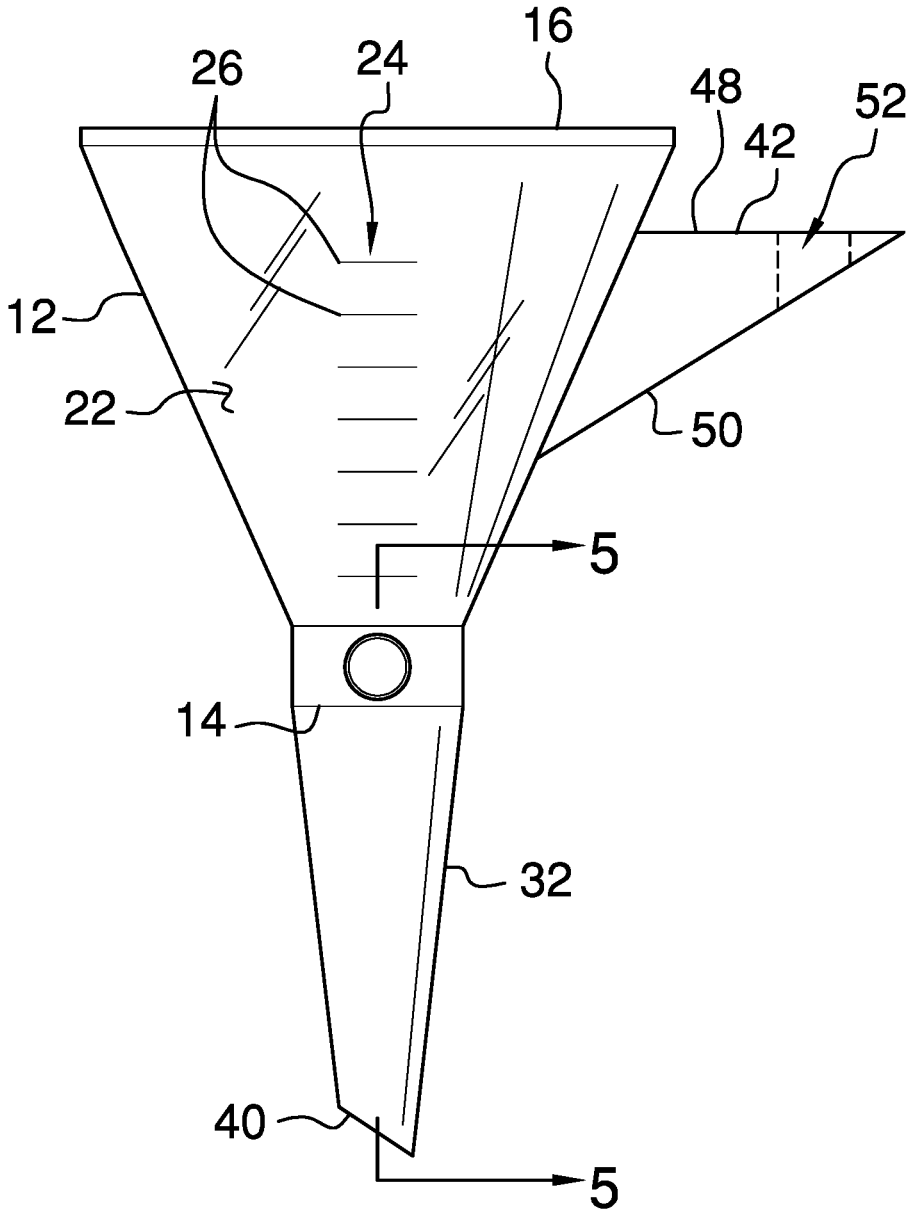
FIG. 4 is a front view of an embodiment of the disclosure.
Figure 5:
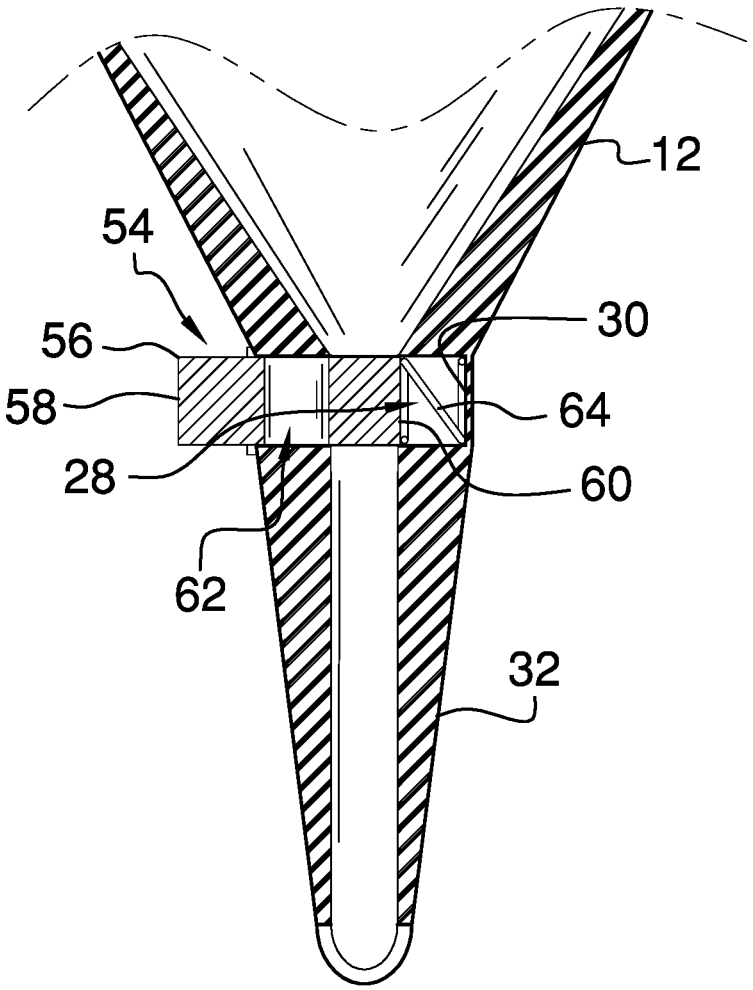
FIG. 5 is a cross sectional view taken along line 5-5 of FIG. 4 of an embodiment of the disclosure.
Figure 6:
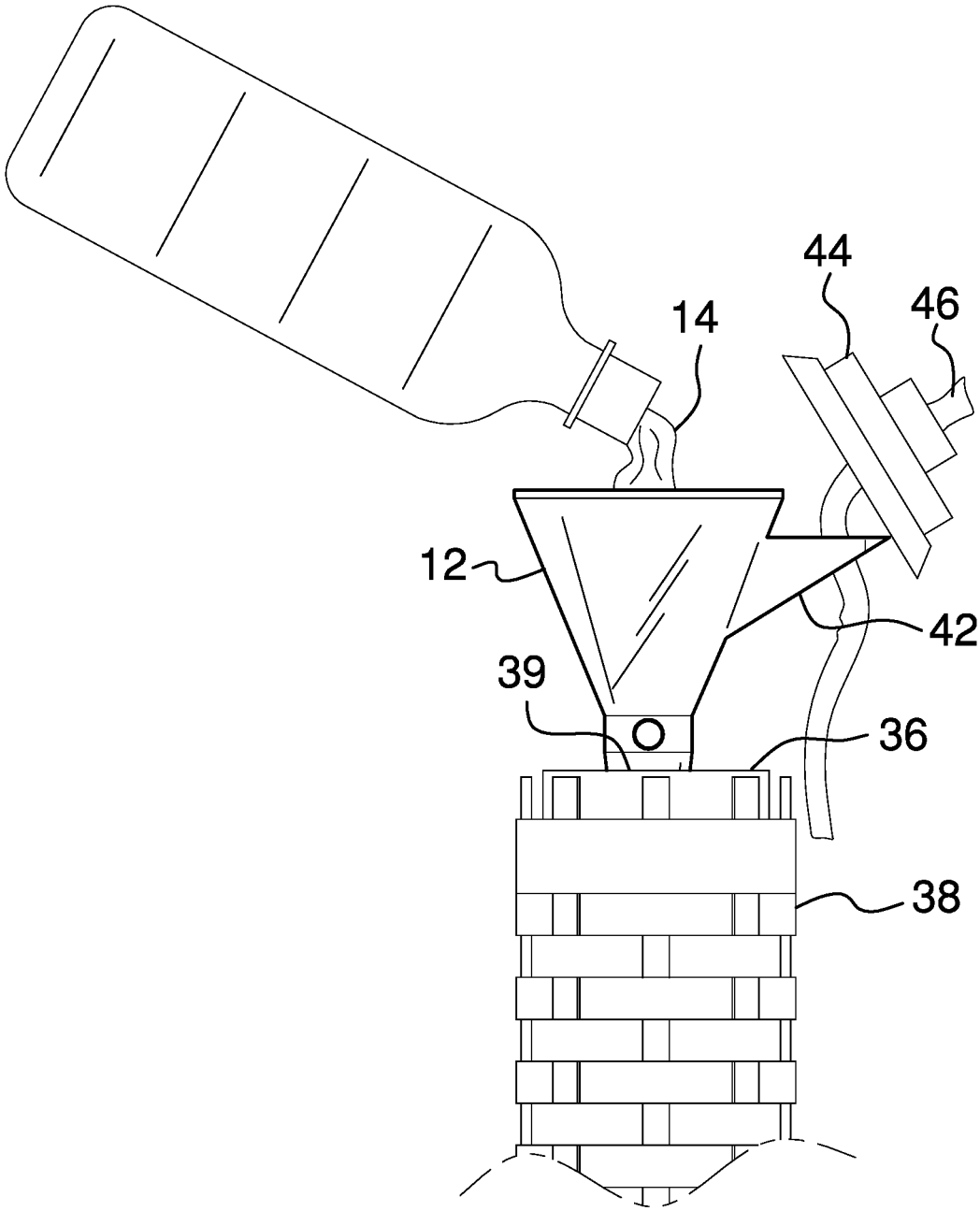
FIG. 6 is a perspective in-use view of an embodiment of the disclosure.

With reference now to the drawings, and in particular to FIGS. 1 through 6 thereof, a new refilling device embodying the principles and concepts of an embodiment of the disclosure and generally designated by the reference numeral 10 will be described.

As best illustrated in FIGS. 1 through 6, the torch refilling assembly 10 generally comprises a funnel 12 for receiving a liquid fuel 14. The funnel 12 has a top end 16, a bottom end 18 and an outer wall 20 extending therebetween. Each of the top end 16 and the bottom end 18 is open and the liquid fuel 14 is selectively poured in the top end 16. The outer wall 20 tapers inwardly between the top end 16 and the bottom end 18. The outer wall 20 is comprised of a translucent material to facilitate the liquid fuel 14 to be visible therethrough.

The outer wall 20 has an outer surface 22 and indicia 24 are printed on the outer surface 22. The indicia 24 comprise lines 26 that are spaced apart from each other and are distributed between the top end 16 and the bottom end 18. Each of the lines 26 has a corresponding number printed next to it to display a fluid volume of the liquid fuel 14 in the funnel 12. The funnel 12 has a well 28 extending laterally therein and the well 28 extends along a line that is oriented perpendicular to a line extending through the top end 16 and the bottom end 18. The well 28 is in fluid communication with an interior of the funnel 12, the well 28 is spaced from the bottom end 18 and the well 28 has a bounding surface 30.

A spout 32 is fluidly coupled to the funnel 12 and the spout 32 is selectively positioned in an opening 34 of a fuel canister 36 of a torch 38. In this way the spout 32 directs the liquid fuel 14 into the fuel canister 36 of the torch 38. The torch 38 may be a tiki torch or the like and the fuel canister 36 may be a fuel canister common to tiki torches. The liquid fuel 14 may be tiki torch fuel, kerosene and any other liquid torch fuel. The spout 32 is positioned on the bottom end 18 of the funnel 12 and the spout 32 is hollow. The spout 32 has a distal end 40 with respect to the bottom end 18. The distal end 40 is open wherein to direct the liquid fuel 14 into the fuel canister 36 of the torch 38.

A rest 42 is coupled to and extends laterally away from the funnel 12. The rest 42 engages a lid 44 of the fuel canister 36 for storage when the fuel canister 36 is filled with the liquid fuel 14. The lid 44 has a wick 46 and the wick 46 is inhibited from getting soiled when the lid 44 is stored on the rest 42. The rest 42 is positioned on the outer surface 22 of the outer wall 20 of the funnel 12.

The rest 42 has a top surface 48, a bottom surface 50 and a distal end 51 with respect to the outer wall 20. Each of the top surface 48 and the bottom surface 50 angle away from each other between the distal end 40 of the rest 42 and the outer wall 20. The rest 42 has an aperture 52 extending through the top surface 48 and the bottom surface 50 to insertably receive the wick 46. The aperture 52 is positioned closer to the distal end 40 of the rest 42 than the outer wall 20 of the funnel 12.

A valve 54 is movably coupled between the funnel 12 and the spout 32. The valve 54 is selectively positioned in a closed position to inhibit the liquid fuel 14 from flowing out of the funnel 12. The valve 54 is selectively positioned in an open position to pass the liquid fuel 14 therethrough thereby facilitating the fuel canister 36 to be filled with the liquid fuel 14. The valve 54 comprises a cylinder 56 that has a first end 58 and a second end 60. The cylinder 56 is slidably positioned in the well 28 and the first end 58 is exposed.

The cylinder 56 has an aperture 62 extending therethrough and the aperture 62 in the cylinder is centrally positioned between the first end 58 and the second end 60. The cylinder 56 is selectively urged into a first position aligning the aperture 62 in the cylinder 56 with the bottom end 18 of the funnel 12. Thus, the aperture 62 in the cylinder 56 passes the liquid fuel 14 into the spout 32 for filling the fuel canister 36. The cylinder 56 is selectively positioned in a second position offsetting the aperture 62 in the cylinder 56 with the bottom end 18. Thus, the cylinder 56 closes the bottom end 18 to inhibit the liquid fuel 14 from passing into the spout 32. A biasing member 64 is positioned between the bounding surface 30 of the well 28 and the second end 60 of the cylinder 56. The biasing member 64 biases the cylinder 56 into the second position and the biasing member 64 may be a spring or the like.

In use, the lid 44 is removed from the fuel canister 36 and the spout 32 is inserted into the opening 34 in the fuel canister 36. The wick 46 is extended through the aperture 52 in the rest 42 and the lid 44 is rested on the rest 42. A selected volume is poured into the funnel 12 that corresponds to a fluid capacity of the fuel canister 36. The lines 26 and numbers on the funnel 12 facilitate a precise amount of the liquid fuel 14 to be poured into the funnel 12 thereby reducing the likelihood of overfilling the fuel canister 36. The first end 58 of the cylinder 56 is depressed to urge the cylinder 56 into the first position to allow the liquid fuel 14 to pour into the fuel canister 36. The lid 44 is replaced on the fuel canister 36 and the wick 46 is lit to employ the torch 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A torch refilling assembly being configured to selectively store and dispense a liquid fuel into a torch, said assembly comprising:

a funnel being configured to receive a liquid fuel, said funnel having a top end, a bottom end and an outer wall extending therebetween, each of said top end and said bottom end being open wherein said top end is configured to have the liquid fuel poured therein, said outer wall tapering inwardly between said top end and said bottom end, said outer wall being comprised of a translucent material wherein said outer wall is configured to facilitate the liquid fuel to be visible therethrough;

a spout being fluidly coupled to said funnel, said spout being configured to be positioned in an opening of a fuel canister of a torch thereby facilitating said spout to direct the liquid fuel into the fuel canister of the torch;

a rest being coupled to and extending laterally away from said funnel wherein said rest is configured to engage a lid of the fuel canister for storage when the fuel canister is filled with the liquid fuel, said rest being positioned on said outer surface of said outer wall of said funnel, said rest having a top surface, a bottom surface and a distal end with respect to said outer wall, each of said top surface and said bottom surface angling away from each other from said distal end of said rest to said outer wall, said rest having an aperture extending perpendicularly through said top surface and through to said bottom surface wherein said aperture is parallel to a central longitudinal axis of said spout and configured to insertably receive a wick on the lid, said top surface being oriented perpendicular to said central longitudinal axis of said spout, said aperture being positioned closer to said distal end of said rest than said outer wall of said funnel; and a valve being movably coupled between said funnel and said spout, said valve being selectively positioned in a closed position wherein said valve is configured to inhibit the liquid fuel from flowing out of said funnel, said valve being selectively positioned in an open position wherein said valve is configured to pass the liquid fuel therethrough thereby facilitating the fuel canister to be filled with the liquid fuel.

2. The assembly according to claim 1, wherein said outer wall has an outer surface, said outer surface having indicia being printed thereon, said indicia comprising lines being spaced apart from each other and being distributed between said top end and said bottom end wherein said lines are configured to display a fluid volume of the liquid fuel in said funnel.

3. The assembly according to claim 1, wherein said funnel has a well extending laterally therein, said well extending along a line being oriented perpendicular to a line extending through said top end and said bottom end, said well being in fluid communication with an interior of said funnel, said well being spaced from said bottom end, said well having a bounding surface.

4. The assembly according to claim 1, wherein said spout is positioned on said bottom end of said funnel, said spout being hollow, said spout having a distal end with respect to said bottom end, said distal end being open wherein said distal end is configured to direct the liquid fuel into the fuel canister of the torch.

5. The assembly according to claim 3, wherein said valve comprises a cylinder having a first end and a second end, said cylinder being slidably positioned in said well having said first end being exposed wherein said first end is configured to be selectively manipulated.

6. The assembly according to claim 5, wherein said cylinder has an aperture extending therethrough, said aperture in said cylinder being centrally positioned between said first end and said second end.

7. The assembly according to claim 6, wherein said cylinder is selectively urged into a first position having said aperture in said cylinder being aligned with said bottom end of said funnel wherein said aperture in said cylinder is configured to pass the liquid fuel into said spout for filling the fuel canister.

8. The assembly according to claim 7, wherein said cylinder is selectively positioned in a second position having said aperture in said cylinder being offset with said bottom end having said cylinder closing said bottom end wherein said cylinder is configured to inhibit the liquid fuel from passing into said spout.

9. The assembly according to claim 5, further comprising a biasing member being positioned between said bounding surface of said well and said second end of said cylinder, said biasing member biasing said cylinder into said second position.

10. A torch refilling assembly being configured to selectively store and dispense a liquid fuel into a torch, said assembly comprising:

a funnel being configured to receive a liquid fuel, said funnel having a top end, a bottom end and an outer wall extending therebetween, each of said top end and said bottom end being open wherein said top end is configured to have the liquid fuel poured therein, said outer wall tapering inwardly between said top end and said bottom end, said outer wall being comprised of a translucent material wherein said outer wall is configured to facilitate the liquid fluid to be visible therethrough, said outer wall having an outer surface, said outer surface having indicia being printed thereon, said indicia comprising lines being spaced apart from each other and being distributed between said top end and said bottom end wherein said lines are configured to display a fluid volume of the liquid fuel in said funnel, said funnel having a well extending laterally therein, said well extending along a line being oriented perpendicular to a line extending through said top end and said bottom end, said well being in fluid communication with an interior of said funnel, said well being spaced from said bottom end, said well having a bounding surface;

a spout being fluidly coupled to said funnel, said spout being configured to be positioned in an opening of a fuel canister of a torch thereby facilitating said spout to direct the liquid fuel into the fuel canister of the torch, said spout being positioned on said bottom end of said funnel, said spout being hollow, said spout having a distal end with respect to said bottom end, said distal end being open wherein said distal end is configured to direct the liquid fuel into the fuel canister of the torch;

a rest being coupled to and extending laterally away from said funnel wherein said rest is configured to engage a lid of the fuel canister for storage when the fuel canister is filled with the liquid fuel, said rest being positioned on said outer surface of said outer wall of said funnel, said rest having a top surface, a bottom surface and a distal end with respect to said outer wall, each of said top surface and said bottom surface angling away from each other between said distal end of said rest and said outer wall, said rest having an aperture extending through said top surface and said bottom surface wherein said aperture is configured to insertably receive a wick on the lid, said aperture being positioned closer to said distal end of said rest than said outer wall of said funnel, said well having a bounding surface; and a valve being movably coupled between said funnel and said spout, said valve being selectively positioned in a closed position wherein said valve is configured to inhibit the liquid fuel from flowing out of said funnel, said valve being selectively positioned in an open position wherein said valve is configured to pass the liquid fuel therethrough thereby facilitating the fuel canister to be filled with the liquid fuel, said valve comprising:

a cylinder having a first end and a second end, said cylinder being slidably positioned in said well having said first end being exposed wherein said first end is configured to be selectively manipulated, said cylinder having an aperture extending therethrough, said aperture being centrally positioned between said first end and said second end, said cylinder being selectively urged into a first position having said aperture being aligned with said bottom end of said funnel wherein said aperture is configured to pass the liquid fuel into said spout for filling the fuel canister, said cylinder being selectively positioned in a second position having said aperture being offset with said bottom end having said cylinder closing said bottom end wherein said cylinder is configured to inhibit the liquid fuel from passing into said spout, and a biasing member being positioned between said bounding surface of said well and said second end of said cylinder, said biasing member biasing said cylinder into said second position.

* * * * *